US008752320B2

(12) United States Patent
Masters

(10) Patent No.: US 8,752,320 B2
(45) Date of Patent: Jun. 17, 2014

(54) FIREARM WITH KEYHOLE-SHAPED RAIL MOUNTING POINTS

(75) Inventor: Philip Steven Masters, Fleet (GB)

(73) Assignee: Accuracy International of North America, Inc., Frederichsburg, VA (US)

( * ) Notice: Subject to any disclaimer, the term of this patent is extended or adjusted under 35 U.S.C. 154(b) by 0 days.

(21) Appl. No.: 12/930,378

(22) Filed: Jan. 5, 2011

(65) Prior Publication Data

US 2012/0167434 A1 Jul. 5, 2012

(51) Int. Cl.
*F41C 23/16* (2006.01)

(52) U.S. Cl.
CPC ..... *F41C 23/16* (2013.01)
USPC ..... 42/71.01

(58) Field of Classification Search
USPC ..... 42/90, 85, 72, 71.01, 96, 77, 124; 411/104, 84
See application file for complete search history.

(56) References Cited

U.S. PATENT DOCUMENTS

| | | | | | |
|---|---|---|---|---|---|
| 2,078,010 | A * | 4/1937 | Meepos | 42/85 |
| 2,102,964 | A * | 12/1937 | Mossberg | 42/85 |
| 3,066,375 | A * | 12/1962 | Knowles et al. | 24/639 |
| 3,512,653 | A * | 5/1970 | Erismann | 211/192 |
| 3,559,940 | A * | 2/1971 | Kruzell | 42/127 |
| 3,798,818 | A * | 3/1974 | Casull | 42/72 |
| 3,844,627 | A * | 10/1974 | Gutner | 384/22 |
| 4,167,884 | A * | 9/1979 | Santanna | 83/671 |
| 5,603,594 | A * | 2/1997 | Lincoln | 411/84 |
| 6,874,269 | B2 * | 4/2005 | Chen et al. | 42/85 |
| 7,216,451 | B1 * | 5/2007 | Troy | 42/72 |
| 8,201,353 | B1 * | 6/2012 | Swan | 42/71.01 |
| 8,245,428 | B2 * | 8/2012 | Griffin | 42/72 |

* cited by examiner

*Primary Examiner* — Reginald Tillman, Jr.
(74) *Attorney, Agent, or Firm* — Bennet K. Langlotz; Langlotz Patent & Trademark Works, Inc.

(57) ABSTRACT

A firearm with keyhole-shaped rail mounting points has a forend element having an exterior surface and interior surface. The forend element defines a plurality of rail mounting apertures extending from the interior surface to the exterior surface. Each of the apertures has a first portion with a first diameter to closely receive a fastener head of a first diameter. Each of the apertures has a second portion with a second width less than the first diameter size to receive a shank portion of a fastener. There may be a recess on the interior surface size to receive the fastener head, the recess positioned at the second portion.

24 Claims, 5 Drawing Sheets

FIREARM WITH KEYHOLE-SHAPED RAIL MOUNTING POINTS

FIELD OF THE INVENTION

The present invention relates to firearms, and more particularly for rail systems for mounting accessories on firearms.

BACKGROUND OF THE INVENTION

Rail systems are used for removably mounting accessories such as optical aiming devices on rifles. Such rails may be integrated with forearms or handguard elements that surround the barrel on firearms, such as the M4/AR15 configuration.

Integrated rails provide a solid and secure mounting location. However, integrated systems must have several rails of substantial length, to be able to accommodate all possible user accessory configurations. This undesirably increases the weight of the system.

Other systems have detachable rails that allow the user to install rails only where they are needed, and only of the length needed. While this decreases weight (and the discomfort and other disadvantages) of having needless rails where the hand is to grip, it suffers from other disadvantages. First, such systems may be difficult or complex to install. Second, they may require custom modification of parts, such as drilling and tapping holes where needed. Third, the attachment locations may be in limited locations due to the need to relocate fasteners such as threaded inserts (or may increase cost and weight by using an excessive number of fasteners).

A further significant disadvantage of systems having modular rails that may be mounted in various locations on the forearm or handguard of a rifle stock is the susceptibility to loosening. If the mount for a rifle scope becomes loose, this can cause significant aiming errors. The user may not notice the loosening or misalignment until after taking a shot that misses or strikes an unintended target.

Therefore, a need exists for a new and improved firearm that can be used to attach rails to a forend tube in such a manner that the rails do not change position over time. In this regard, the various embodiments of the present invention substantially fulfill at least some of these needs. In this respect, the firearm with keyhole-shaped rail mounting points according to the present invention substantially departs from the conventional concepts and designs of the prior art, and in doing so provides an apparatus primarily developed for the purpose of attaching rails to a forend tube in such a manner that the rails do not change position over time.

An example of an approach to attaching an object to a surface using a keyhole slot is found on an adjustable slide board, which is from a field that is not analogous to the current invention. The slide board features two sets of longitudinally aligned keyhole slots. Bumpers are attached to the upper surface of the slide board by inverted T-nuts inserted into the keyhole slots and thumbscrews passed through bores in either end of the bumpers and threaded into the T-nuts. The underside of the slide board includes recesses at the narrow end of each keyhole slot that receive the heads of the T-nuts to secure the T-nuts within the keyhole slots when the thumbscrews are tightened. The bumpers are positioned laterally across the width of the upper surface of the slide board. The two sets of keyhole slots are offset so that the bumpers are attached at an angle to the sides of the slide board rather than perpendicularly.

SUMMARY OF THE INVENTION

The present invention provides an improved firearm with keyhole-shaped rail mounting points, and overcomes the above-mentioned disadvantages and drawbacks of the prior art. As such, the general purpose of the present invention, which will be described subsequently in greater detail, is to provide an improved firearm with keyhole-shaped rail mounting points that has all the advantages of the prior art mentioned above.

To attain this, the preferred embodiment of the present invention essentially comprises a forend element having an exterior surface and interior surface. The forend element defines a plurality of rail mounting apertures extending from the interior surface to the exterior surface. Each of the apertures has a first portion with a first diameter to closely receive a fastener head of a first diameter. Each of the apertures has a second portion with a second width less than the first diameter size to receive a shank portion of a fastener. There may be a recess on the interior surface size to receive the fastener head, the recess positioned at the second portion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
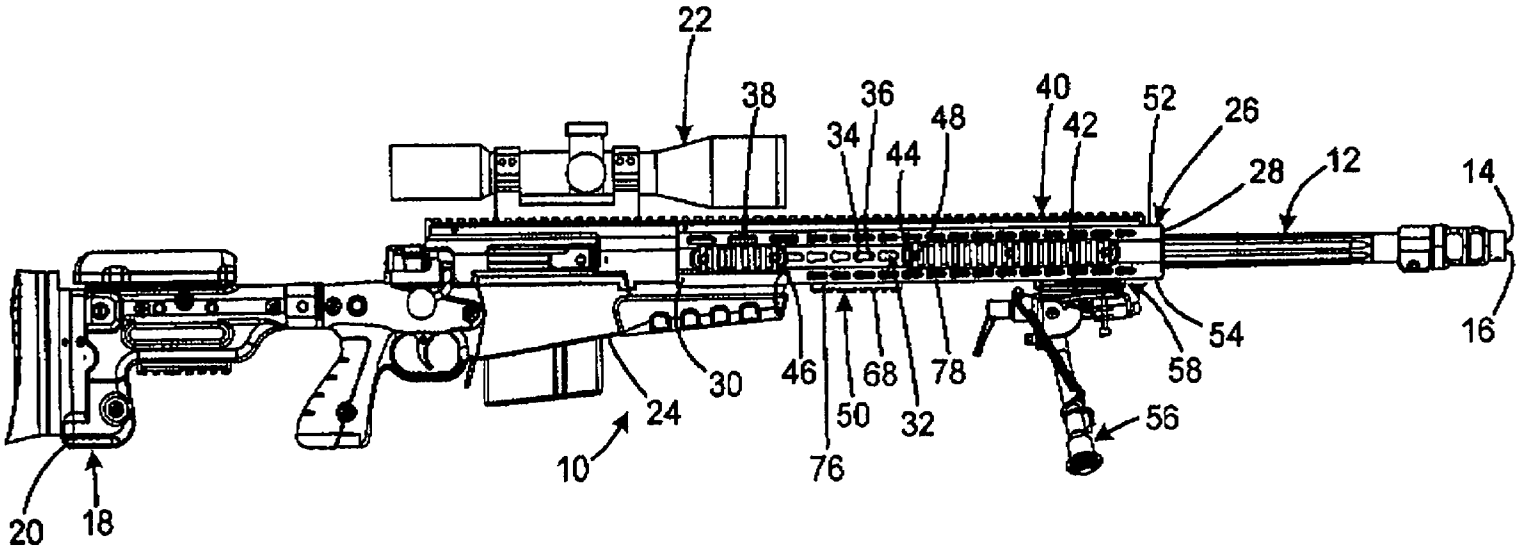
FIG. 1 is a side view of the current embodiment of the firearm with keyhole-shaped rail mounting points constructed in accordance with the principles of the present invention.

A preferred embodiment of the firearm with keyhole-shaped rail mounting points of the present invention is shown and generally designated by the reference numeral 10.

FIG. 1 illustrates improved firearm with keyhole-shaped rail mounting points of the present invention. More particularly, the firearm with keyhole-shaped rail mounting points 10 is a rifle. The rifle has a stock 18 at its rear 20 and a barrel 12 with a muzzle 14 at its front 16. The muzzle end of the barrel protrudes from the front 28 of a handguard or forend tube 26. An upper receiver 24 connects the rear 30 of the forend tube to the stock.

The top 52 of the forend tube forms an integral upper rail 40, although this may be omitted in alternative embodiments, or replaced with a modular rail according to a preferred embodiment of the invention. A scope 22 is attached to the upper rail 40. A plurality of ventilation holes 38 is present in the rear of the forend tube. The ventilation holes prevent the barrel from overheating when the firearm is fired repeatedly. The exterior 78 of the forend tube is octagonal in shape, forming eight exterior surfaces. Each of these surfaces, except for the top one, has a plurality of keyhole slots 32. In alternative embodiments, any polygonal, circular, elliptical, or other cross section may be employed.

The keyhole slots 32 are axially aligned into rows that each run parallel to the major axis of the forend and barrel. Each keyhole slot has a wider circular rear portion 34 and a narrower oblong front portion 36. The keyhole slots enable short rail 46, short rail with flush cup mount 50, short rail 58, and long rail 42 to be securely mounted to the forend tube with fasteners in a manner that will be described in more detail subsequently. A bipod 56 is shown attached to the short rail 58. However, any combination of rail locations, quantities, and lengths may be used.

The modular rail segments enable the user to position rails of the size that is needed at only the locations where they are needed. Being able to control the amount of forend tube exterior surface that is encumbered by rails makes the firearm lighter and less likely to catch on objects.

Figure 2:
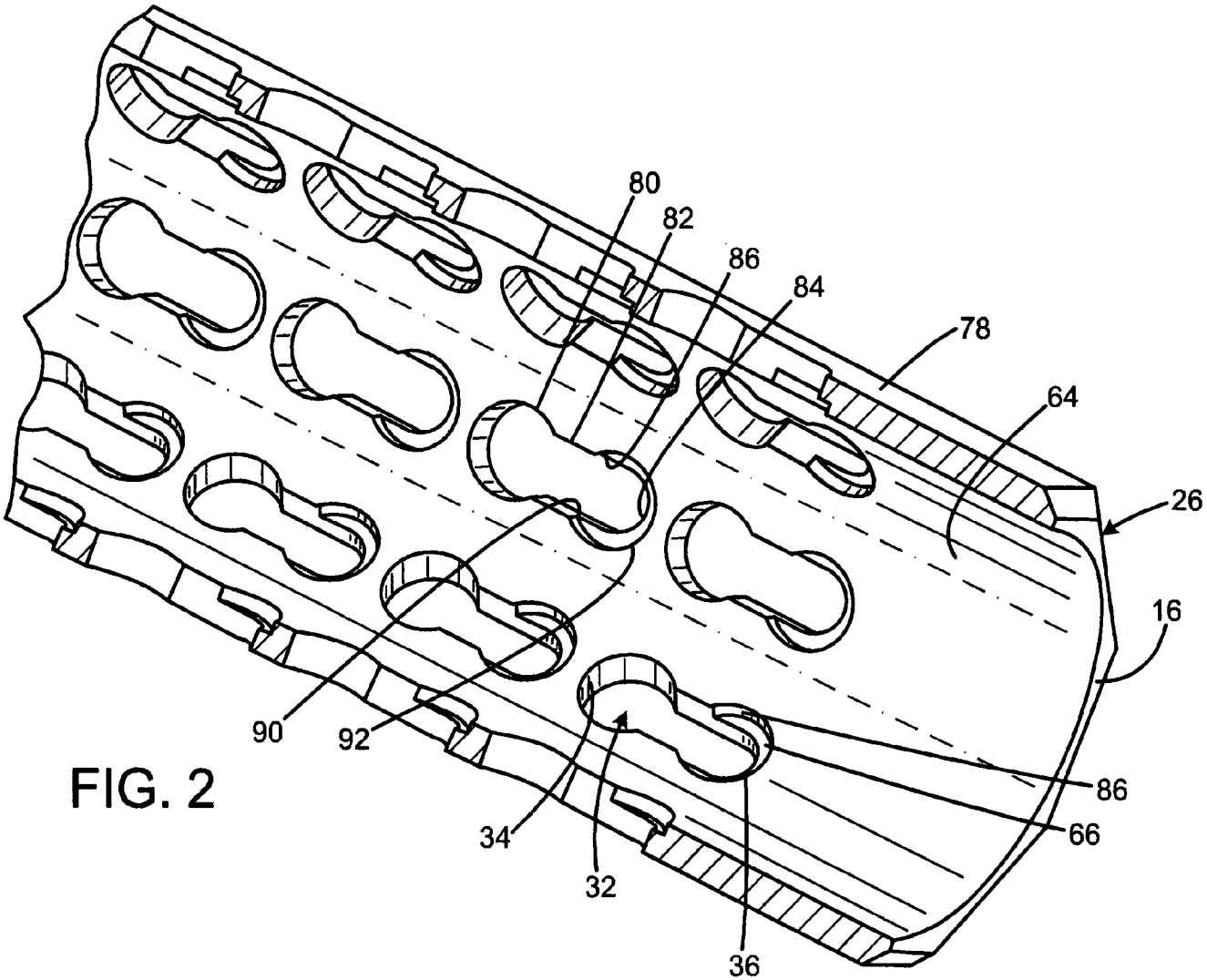
FIG. 2 is a side sectional perspective view of the current embodiment of the forend tube of the present invention.

FIG. 2 illustrates the interior 64 of the forend tube 26 of the present invention. More particularly, the keyhole slots 32 present in the forend tube are clearly visible. The forend tube has a thickness of 3.0 mm. Each keyhole slot opens through the forend tube and has a wider rear 34 that narrows at the front 36. This orientation prevents recoil from causing a fastener inserted into the keyhole slot from sliding out the wider end of the keyhole slot.

The rear of the keyhole slot defines a circular arc segment 80 having a diameter of 8.0 mm. The arc segment 80 opens into a rectangular portion 82 that is 7.1 mm long and 5.5 mm wide. The front of the rectangular portion 82 terminates in a circular arc segment having a diameter of 5.5 mm that forms an interior front surface 84. An interior surface portion of the front of the rectangular portion 82 opens into a recess 66 defined by a circular arc segment 92 having a diameter of 8.0 mm, which is closely proportionate to that diameter of aperture portion 80. The recess is 1 mm deep at its minimum and has interior rear surfaces 86 and 90. The recess 66 in the interior surface of the forend tube at the front of the keyhole slot closely receives the head of a fastener, and prevents a tightened or even slightly loosened fastener from sliding rearwards within the keyhole slot, even if the fastener is only loosely tightened.

Figure 3:
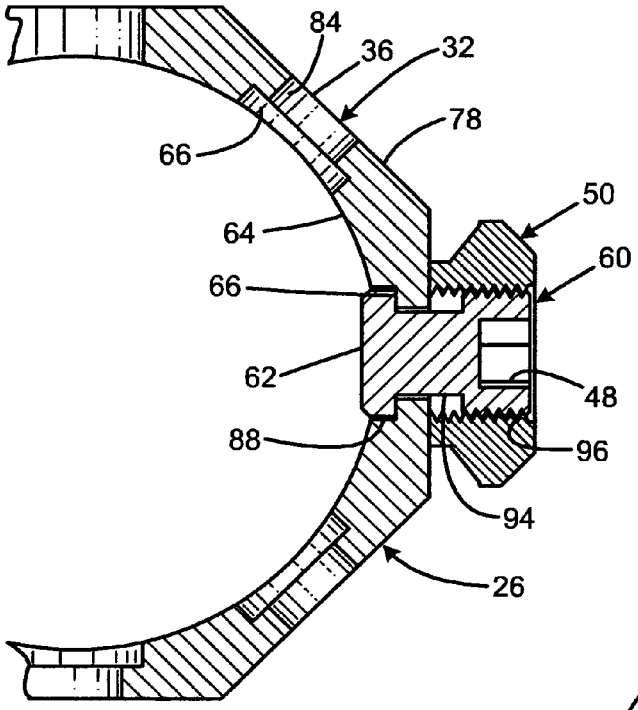
FIG. 3 is an end sectional view of the current embodiment of the forend tube of the present invention.

FIG. 3 illustrates the forend tube 26 of the present invention with a fastener 60 inserted through the keyhole slot 32 to attach a short rail with flush cup mount 50 to the forend tube. More particularly, the fastener 60 is a T-nut having a shaft portion 94 and a disc-shaped head 62 with an outer diameter surface 88. The head has a diameter of 7.6 mm, which is sized to be closely received by the recess 66, and a thickness of 2.0 mm. The shaft portion has a diameter of 5.0 mm, which is sized to be closely received by the front of the rectangular portion 82, and a length of 4.0 mm. The T-nut is inverted so that the disc-shaped head is inserted through the wider rear portion of the keyhole slot and positioned within the forend tube. The head has a diameter that is slightly less than that of the wider rear portion of the keyhole slot, but is greater than the narrower front portion of the keyhole slot. The recess 66 at the front of the keyhole slot is sized to closely receive the head. Both the outer diameter surface of the head and the interior surfaces of the recess may be tapered to provide a centered fit in the manner of a flat head screw without relying on a close dimensional match between recess and head diameter.

In addition to the plain head 62 that engages with the key hole slot's recess 66, the T-nut includes a threaded portion 96 that terminates in an M8×4 mm threaded hex socket head 46. This features a left-hand thread so the user tightens the socket head in an intuitive clockwise direction although the head 62 is actually drawing out and into the recess 66 in the forend tube. Each T-nut is fabricated as a single piece.

Figure 4:
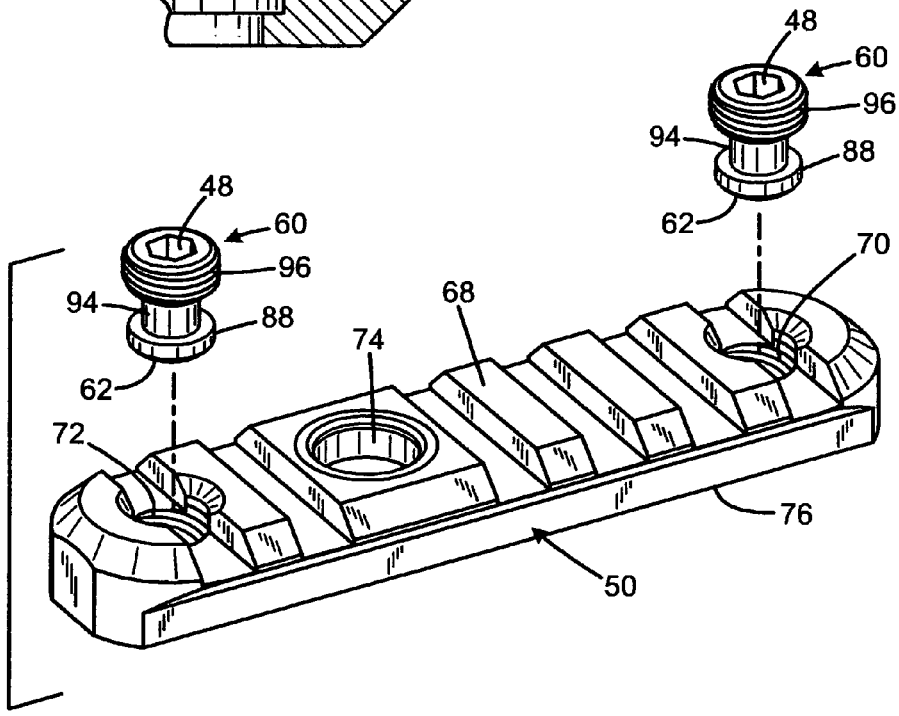
FIG. 4 is a top perspective view of the current embodiment of the short rail with flush cup mount of the present invention.

FIG. 4 illustrates the short rail with flush cup mount 50 of the present invention with T-nuts 60. More particularly, the rail 50 has threaded bores 70 and 72 at either end, and a flush cup mount 74 formed by its top 68. The threaded bores each receive the threaded portion 96 of a T-nut prior to being attached to the exterior surface of the forend tube.

Figure 5:
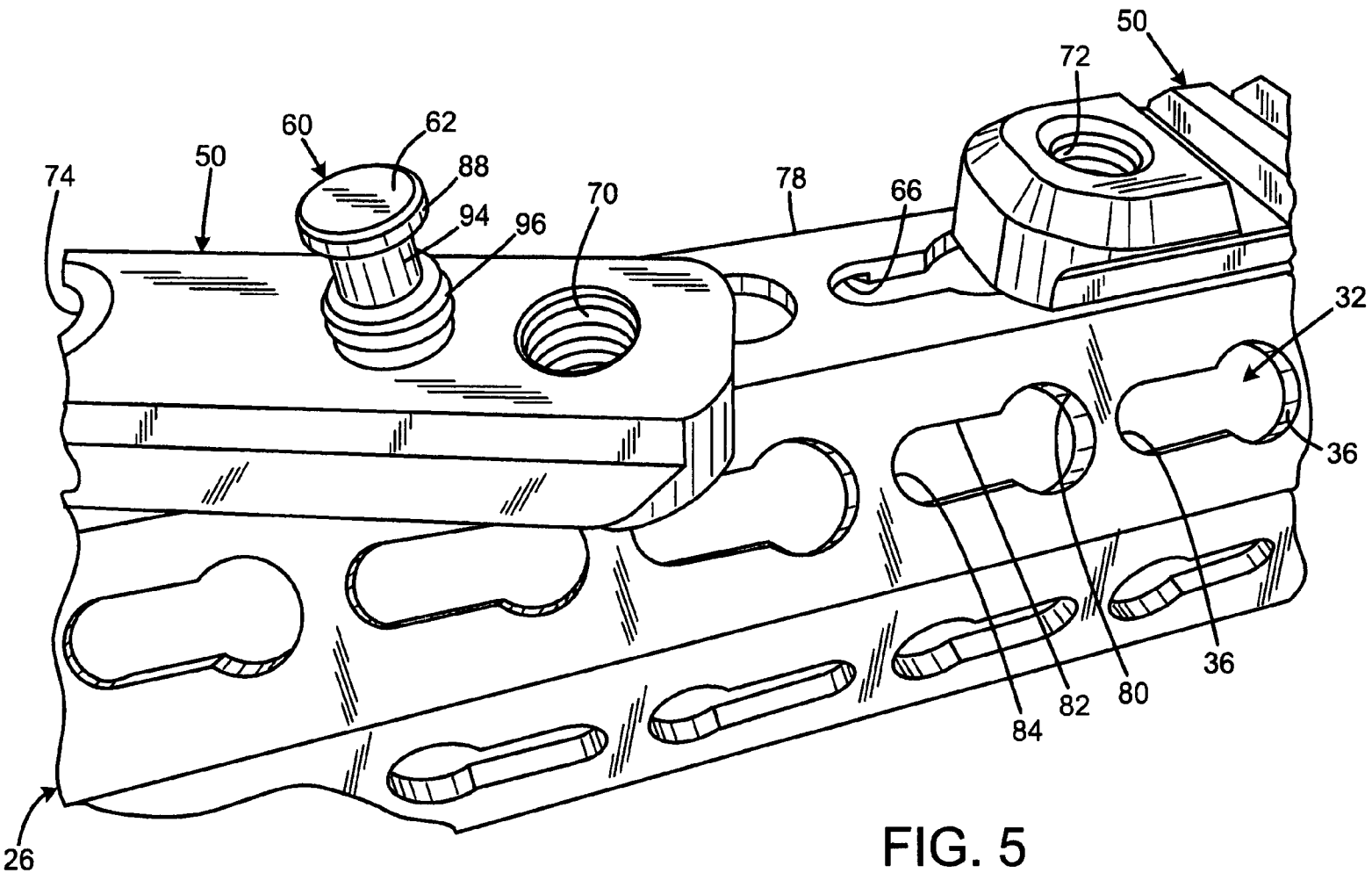
FIG. 5 is a top perspective fragmentary view of the current embodiment of the short rail with flush cup mount, and the forend tube of the present invention.
Figure 6:
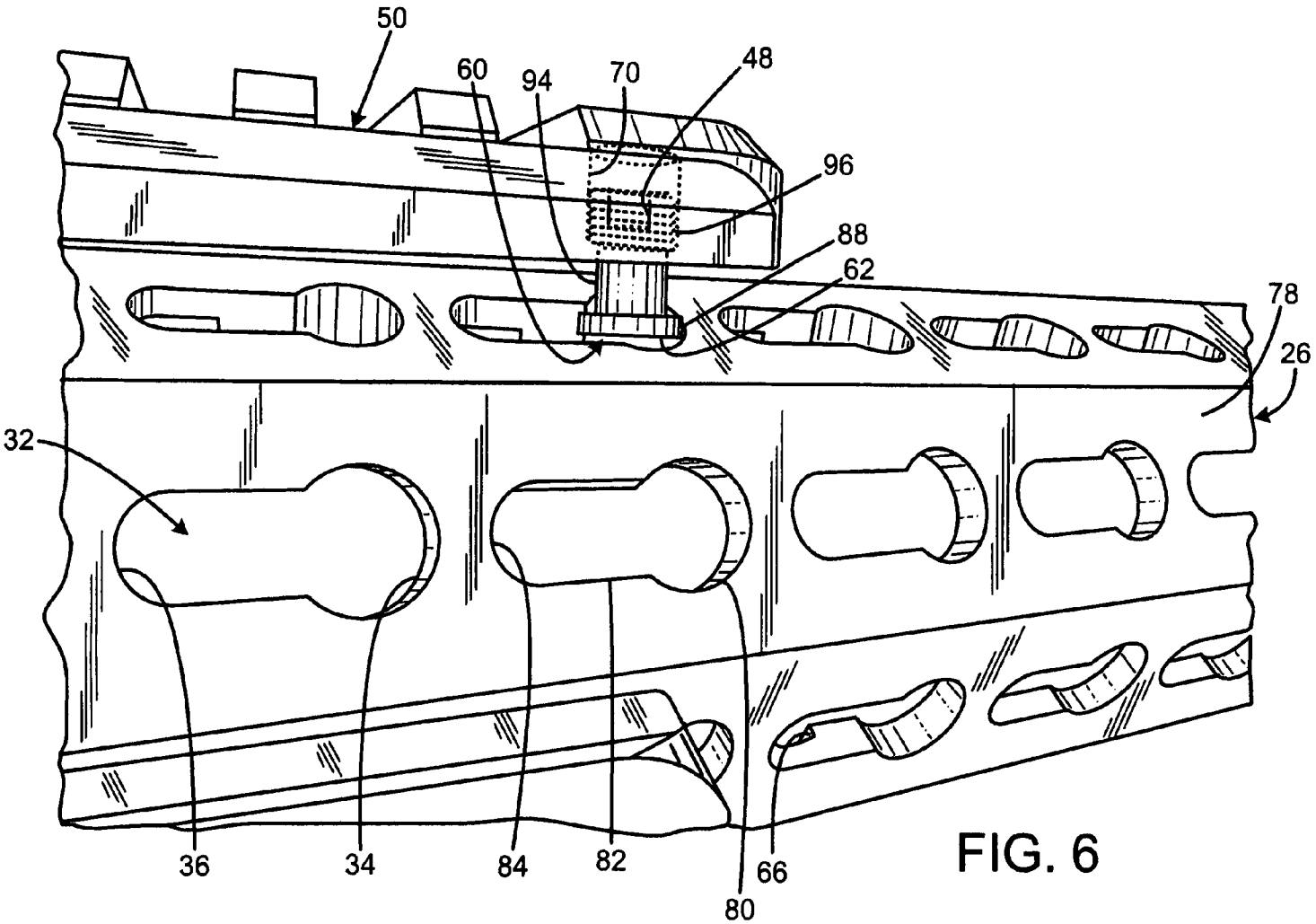
FIG. 6 is a side sectional fragmentary view of the current embodiment of the short rail with flush cup mount and the forend tube of the present invention.

FIGS. 5 & 6 illustrate how the short rail with flush cup mount 50 of the present invention is attached to the exterior surface of the forend tube by T-nuts 60. The T-nuts enable the rail 50 (as well as short rails 46 and 58 and long rail 42) to be removably attached to the exterior surface of the forend tube by first threadedly engaging the threaded portion 96 of a T-nut with the threads in each of the bores in the rail. The T-nuts are positioned within the threaded bores so that the head 62 protrude below the rail by an amount exceeding the thickness of the forend tube. Subsequently, the heads 62 of the T-nuts are axially inserted perpendicularly to an exterior surface of the forend tube into corresponding rear portions of the keyhole slots in the desired locations on the exterior surface. Subsequently, sliding the rail forward parallel to the exterior surface of the forend tube from the rear portion of the keyhole slot into the front portion secures the bottom 76 of the rail to the exterior surface. The socket heads 48 are subsequently tightened by turning the socket heads 48 clockwise to pull the heads of the T-nuts into the recesses 66 in the interior surface of the forend tube to secure the heads within the recesses. Rearward dislocation is prevented by the outer diameter surface 88 of head 62 contacting the interior rear surfaces 86 and 90 of the recess 66. Forward dislocation is prevented by the shaft portion 94 of the T-nut contacting the interior front surface 84 of the keyhole slot 32.

Tightening the socket heads 46 also creates a clamping action between the head 62 and the forend tube to further secure the rail in position.

To remove the rail from the exterior surface, the socket heads are loosened by rotating them counterclockwise so the heads of the T-nuts can be raised above the recesses. Subsequently, the rail is slid backward, parallel to the exterior surface of the forend tube from the front portion of the keyhole slot into the rear portion. The heads of the T-nuts can then be withdrawn from the rear portion of the keyhole slots by axially lifting the rail perpendicularly to the exterior surface.

In the context of the specification, the terms "rear" and "rearward" and "front" and "forward" have the following definitions: "rear" or "rearward" means in the direction away from the muzzle of the firearm, while "front" or "forward" means in the direction towards the muzzle of the firearm.

While a current embodiment of the firearm with keyhole-shaped rail mounting points has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm rail mounting facility for connecting an accessory to a forward portion of a firearm, the facility comprising:

a firearm forend barrel shroud tube element having an exterior surface operable for gripping by a user and an interior surface defining a barrel passage;

the firearm forend barrel shroud element defining a plurality of rail mounting apertures extending from the interior surface to the exterior surface;

each of the apertures having a first portion with a first diameter to closely receive a fastener head of a first diameter; and each of the apertures having a second portion with a second width less than the first diameter sized to receive a shank portion of a fastener.

2. The mounting facility of claim 1 further comprising a recess on the interior surface of the second portion sized to receive the fastener head, the recess positioned at the second portion.

3. A firearm with keyhole-shaped rail mounting points comprising:

a firearm forend tube encompassing at least a portion of a barrel of the firearm and having a body with an exterior surface;

the exterior surface of the body including a mating feature;

the mating feature comprising a first aperture and a second aperture, each having a diameter;

a rail segment removably attached to the body;

the rail segment including a mating element;

wherein the mating element has a first portion having a diameter smaller than the diameter of both the first aperture and the second aperture; and wherein the matins element has a second portion having a diameter that is smaller than the diameter of the first aperture and larger than the diameter of the second aperture.

4. The firearm of claim 3, wherein the mating element is formed so it passes axially through the first aperture without obstruction and wherein the mating element is formed so it cannot pass axially through the second aperture without obstruction.

5. The firearm of claim 3, wherein the first aperture and the second aperture have different diameters.

6. The firearm of claim 3, wherein the first aperture and the second aperture are in communication with one another.

7. The firearm of claim 3, wherein the mating element is a surface of rotation.

8. The firearm of claim 3, wherein the second portion is a flange projecting outwards from the first portion.

9. The firearm of claim 3, wherein the forend tube has an interior surface that forms a recess around the second aperture.

10. The firearm of claim 9, wherein the recess is sized to closely receive the second portion.

11. The firearm of claim 10, wherein the rail segment is clamped between the mating element and the second portion when the mating element is inserted into the second aperture and the mating element is tightened into the rail segment.

12. A firearm with keyhole-shaped rail mounting points, including a barrel having a muzzle, comprising:

a firearm forend barrel shroud tube having a body with an exterior surface;

the exterior surface of the body including the mounting points; and wherein the mounting points are keyhole-shaped apertures having a wide end and a narrow end.

13. The firearm of claim 12, wherein the keyhole-shaped apertures are aligned parallel to the barrel with their narrow ends pointing towards the muzzle and their wider ends pointing away from the muzzle.

14. The firearm of claim 12, further comprising a plurality of mounting points aligned longitudinally parallel to the barrel.

15. The firearm of claim 14, further comprising:

a rail segment removably attached to the body;

the rail segment including a plurality of mating elements received by the mounting points; and wherein the rail segment is aligned longitudinally parallel to the barrel.

16. The firearm of claim 15, wherein the rail segment is a rail system for mounting accessories on a firearm.

17. The firearm of claim 15, wherein the mating elements are inverted T-nuts.

18. The firearm of claim 15, wherein the mating elements are formed so they pass axially through the wide end of the mounting points without obstruction and cannot pass axially through the narrow end of the mounting points without obstruction.

19. The firearm of claim 15, wherein the mating elements have a first portion having a diameter smaller than the diameter of both the wide end of the mounting points and the narrow end of the mounting points and wherein the mating elements have a second portion having a diameter that is smaller than the diameter of the diameter of the wide end of the mounting points and larger than the diameter of the narrow end of the mounting points.

20. The firearm of claim 15, wherein the mating elements are surfaces of rotation.

21. The firearm of claim 19, wherein the second portion is a flange projecting outwards from the first portion.

22. The firearm of claim 15, wherein the forend tube has an interior surface that forms a recess around the narrow end of the mounting points.

23. The firearm of claim 22, wherein the recess is sized to closely receive the second portion.

24. The firearm of claim 19, wherein the rail segment is clamped between the mating elements and the second portion when the mating elements are inserted into the narrow end of the mounting points and the mating elements are tightened into the rail segment.

* * * * *